US009981670B2

(12) United States Patent
Combeau et al.

(10) Patent No.: US 9,981,670 B2
(45) Date of Patent: May 29, 2018

(54) GANGWAY ARRANGEMENT, INTENDED TO EQUIP A PUBLIC TRANSPORT JOINTED VEHICLE, IN PARTICULAR A RAILWAY VEHICLE

(71) Applicant: ALSTOM TRANSPORT TECHNOLOGIES, Levallois Perret France (FR)

(72) Inventors: Eric Combeau, Niort (FR); Frédéric Le Breton, Nieul sur Mer (FR); Gaëtan Menanteau, Saint Xandre (FR); Yann Pinaud, La Rochelle (FR)

(73) Assignee: Alstom Transport Technologies, Levallois Perret (FR)

( * ) Notice: Subject to any disclaimer, the term of this patent is extended or adjusted under 35 U.S.C. 154(b) by 239 days.

(21) Appl. No.: 14/934,047

(22) Filed: Nov. 5, 2015

(65) Prior Publication Data

US 2016/0129922 A1 May 12, 2016

(30) Foreign Application Priority Data

Nov. 6, 2014 (FR) ..... 14 60729

(51) Int. Cl.
*B61D 17/04* (2006.01)
*B61D 17/20* (2006.01)
(Continued)

(52) U.S. Cl.
CPC ..... *B61D 17/043* (2013.01); *B61D 1/04* (2013.01); *B61D 17/20* (2013.01); *B61F 5/50* (2013.01)

(58) Field of Classification Search
CPC ..... B61D 17/043; B61D 17/20; B61D 17/22
(Continued)

(56) References Cited

U.S. PATENT DOCUMENTS 1,168,335 A 1/1916 Rowntree
3,030,897 A 4/1962 Barry
4,579,063 A * 4/1986 Losa ..... B61D 13/00 105/4.4

FOREIGN PATENT DOCUMENTS

FR 2581016 A1 10/1986
GB 689147 A 3/1953
WO 2014/029785 A1 2/2014

OTHER PUBLICATIONS

Search Report dated Jun. 24, 2015 in corresponding FR application No. 1460729.

* cited by examiner

*Primary Examiner* — Zachary L Kuhfuss
(74) *Attorney, Agent, or Firm* — Knobbe, Martens, Olson & Bear, LLP

(57) ABSTRACT

A gangway arrangement can be laid out between two bodies of a public transport jointed vehicle, such as a railway vehicle. The gangway arrangement includes at least one seat for at least one passenger. The gangway arrangement can be connected through a pivot connection to the end portion of one of the bodies. The end portion includes an access corridor delimited by two opposite edges. The seat has an end extending to one of the edges when the gangway arrangement is connected to the body. An angular spacing is provided between the end of the seat and the edge, when the longitudinal direction is aligned with the longitudinal axis of the corresponding body. This angular spacing is relative to the pivot connection, and corresponds to the angle formed between the longitudinal axis of the body and the longitudinal direction when the tilt between both bodies is maximum.

14 Claims, 3 Drawing Sheets

(51) Int. Cl.
*B61D 1/04* (2006.01)
*B61F 5/50* (2006.01)

(58) Field of Classification Search
USPC ..... 105/8.1, 15
See application file for complete search history.

GANGWAY ARRANGEMENT, INTENDED TO EQUIP A PUBLIC TRANSPORT JOINTED VEHICLE, IN PARTICULAR A RAILWAY VEHICLE

The present invention relates to a gangway arrangement, intended to equip a public transport jointed vehicle, notably a railway vehicle.

A public transport jointed vehicle, known in the state of the art, includes at least two bodies, jointed with each other by means of a gangway arrangement laid out between both of these bodies. Such a gangway arrangement notably allows circulation of passengers from one body to the other.

The object of the present invention is notably to improve the comfort of such a public transport jointed vehicle.

For this purpose, the object of the invention is notably a gangway arrangement, intended to be laid out between two bodies of a public transport jointed vehicle, notably of a railway vehicle, the gangway arrangement extending along a longitudinal direction, characterized in that it includes at least one seating member for at least one passenger and in that:

- the gangway arrangement is intended to be connected through a pivot connection to an end portion of one of the bodies, this body extending along a longitudinal axis and the end portion comprising an access corridor, delimited by two opposite edges,
- the seating member has an end intended to extend one of the edges when the gangway arrangement is connected to the body,
- an angular distance is provided between the end of the seating member and the edge which it extends, when the longitudinal direction is aligned with the longitudinal axis of the corresponding body, this angular distance being considered with respect to the pivot connection with the corresponding body, and this angular distance substantially corresponds to the angle formed between the longitudinal axis of the body and the longitudinal direction when the tilt between both bodies is maximum.

In a gangway arrangement of the state of the art, it is notably possible in the case of substantial traffic that passengers remain therein in the standing position. However, the comfort for these passengers traveling standing up in the gangway arrangement is reduced, notably from the fact of movements experienced with this gangway arrangement, in particular in bends, because of which it may be difficult for these passengers to retain their balance.

On the other hand, the invention intends to lay out at least one seating member in the gangway arrangement, thus allowing the passengers to travel in a seated position in this gangway arrangement. The gangway arrangement therefore improves the comfort of the passengers which remain therein, and reduces the problems of imbalances mentioned earlier.

Moreover it should be noted that the gangway arrangement according to the invention gives the possibility of increasing the capacity of the transport vehicle in the number of seats, and this without modifying the dimensions of this transport vehicle. The overall comfort of the transport vehicle is therefore also improved.

A gangway arrangement according to the invention may further include one or several of the following features, taken alone or according to all combinations which may be technically contemplated.

- The gangway arrangement includes a platform, provided with two pivot connections, each intended to connect the platform to respectively one of the bodies.
- The gangway arrangement includes a platform provided with a pivot connection, intended to connect the platform to each of the bodies.
- The seating member is secured to the platform.
- The platform has a general rounded shape, for example oblong.
- The platform includes a central portion, forming a corridor for circulation of persons, and two side portions on either side of the central portion, the seating member being laid out in one of the side portions.
- Each side portion includes at least one seating member, notably a bench seat, substantially extending in a longitudinal direction, the spacing between the seating members, taken in a transverse direction perpendicular to the longitudinal direction, being greater than 450 mm.

The invention also relates to a public transport vehicle, notably a railway vehicle, including two adjacent bodies, characterized in that it includes a gangway arrangement as defined earlier, laid out between both bodies.

A transport vehicle according to the invention may further include either one of the following features, taken alone or as a combination.

- The body includes an end portion connected to the gangway arrangement, comprising a corridor for accessing the gangway arrangement, opening onto said circulation corridor, and delimited by two side edges, the distance between each side edge and the seating member laid out in the opposite side portion being greater than 450 mm regardless of the tilt of the bodies relatively to each other.
- The transport vehicle comprises at least one bogie laid out below said platform and being secured to this platform.
- The transport vehicle comprises at least two axles, each of said axles being laid out below respectively one of said bodies, and being secured to the latter.

The invention will be better understood upon reading the description which follows, only given as an example and made with reference to the appended figures, wherein.

Figure 1:
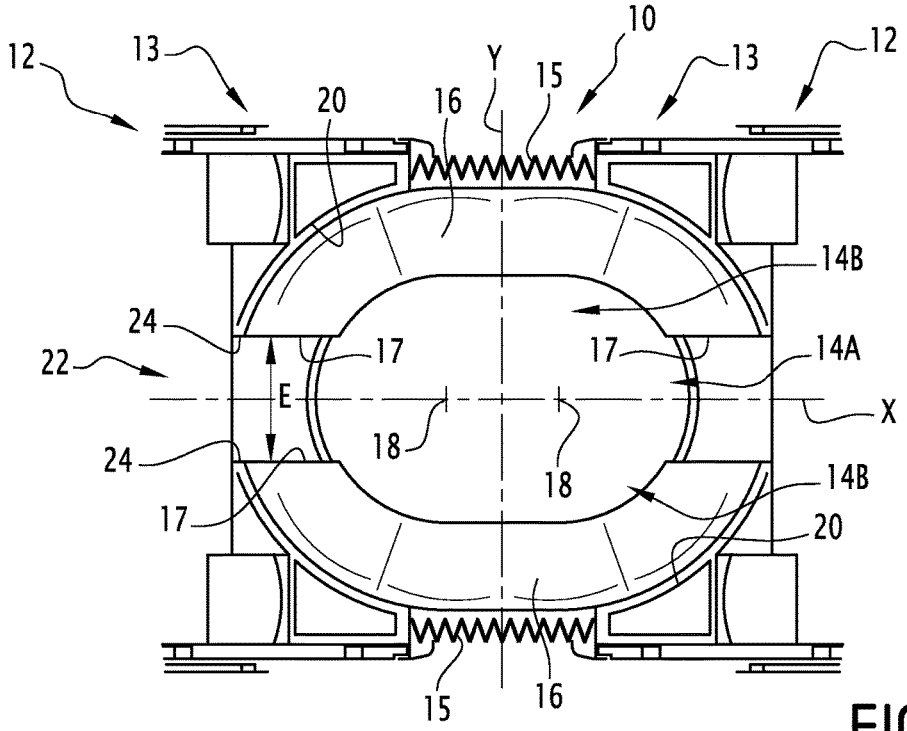
FIG. 1 is a schematic view of the top of a gangway arrangement according to a first exemplary embodiment of the invention, equipping a public transport vehicle.

A gangway arrangement 10 according to a first exemplary embodiment of the invention is illustrated in FIG. 1.

The gangway arrangement 10 is laid out between two bodies 12 of a public transport jointed vehicle, notably a railway vehicle such as a tramway or a subway train. In FIG. 1, the bodies 12 are illustrated partially. More particularly, only end portions 13 of these bodies 12, to which is connected the gangway arrangement 10, are visible in FIGS. 1 and 2. The remainder of the bodies 12 is standard and will therefore not be further described.

Of course, the public transport vehicle may include more than two bodies 12, in which case gangway arrangements, including at least one which is a gangway arrangement 10 according to the invention, are each laid out between two adjacent respective bodies. Thus, a transport vehicle including at least one gangway arrangement according to the invention and at least one standard gangway arrangement may be provided alternatively.

The gangway arrangement 10 according to the invention includes a platform 14, intended to be used by passengers.

Advantageously, the platform 14 has a rounded general shape. More particularly, in the illustrated example, the platform 14 has a general oblong shape.

The platform 14 includes a central portion 14A, forming a corridor for circulation of persons extending in a longitudinal direction X, and two lateral portions 14B positioned on either side of the central portion 14A in a transverse direction Y perpendicular to the longitudinal direction X.

It should be noted that, as each body 12 extends in the direction of a respective longitudinal axis A, the longitudinal direction X is parallel to each longitudinal axis A when the bodies 12 are aligned, notably when the transport vehicle circulates on a straight line. On the other hand, the longitudinal direction X forms an angle $\alpha$ with each longitudinal axis A when the bodies 12 are tilted relatively to each other, notably when the transport vehicle circulates on a curve.

The gangway arrangement 10 is delimited, in the transverse direction Y, by bellows 15 of a standard type, each extending between side walls of the bodies 12.

The gangway arrangement 10 according to the invention includes at least one seating member 16. This seating member 16 is for example a seat, on which a passenger may sit, a seat bench, on which several passengers may sit beside each other or a set of aligned seats.

Advantageously, each side portion 14B includes a seating member 16 for at least one passenger. The seated members 16 are therefore opposite to each other in the transverse direction Y.

In the illustrated example, each seating member 16 is a seat bench, substantially extending in the longitudinal direction X, having a general curved shape substantially parallel to a contour of the corresponding side portion 14B of the platform 14. Each seat bench 16 extends between two ends 17. Thus, as these seat benches 16 are curved, each end 17 of a seat bench 16 is substantially located facing one of the ends 17 of the opposite seat bench 16.

The spacing E between the opposite seating members 16, taken in the transverse direction Y, is greater than 450 mm so that the circulation corridor 14A has a sufficient width for allowing passing of persons, even when the passengers are sitting on these seating members 16. This spacing E is defined as the distance between the closest points of the opposite seating members 16 in the transverse direction Y.

In the illustrated example, as the seated members 16 are curved, said spacing E corresponds to the distance between the ends 17 facing these opposite seating members.

Each seating member 16 is secured to the platform 14, so that the movements of this seating member 16 are related to the movements of the platform 14, and not directly to the movements of either one of the bodies 12. This gives the possibility of improving the comfort of the passengers sitting on this seating member 16.

Figure 2:
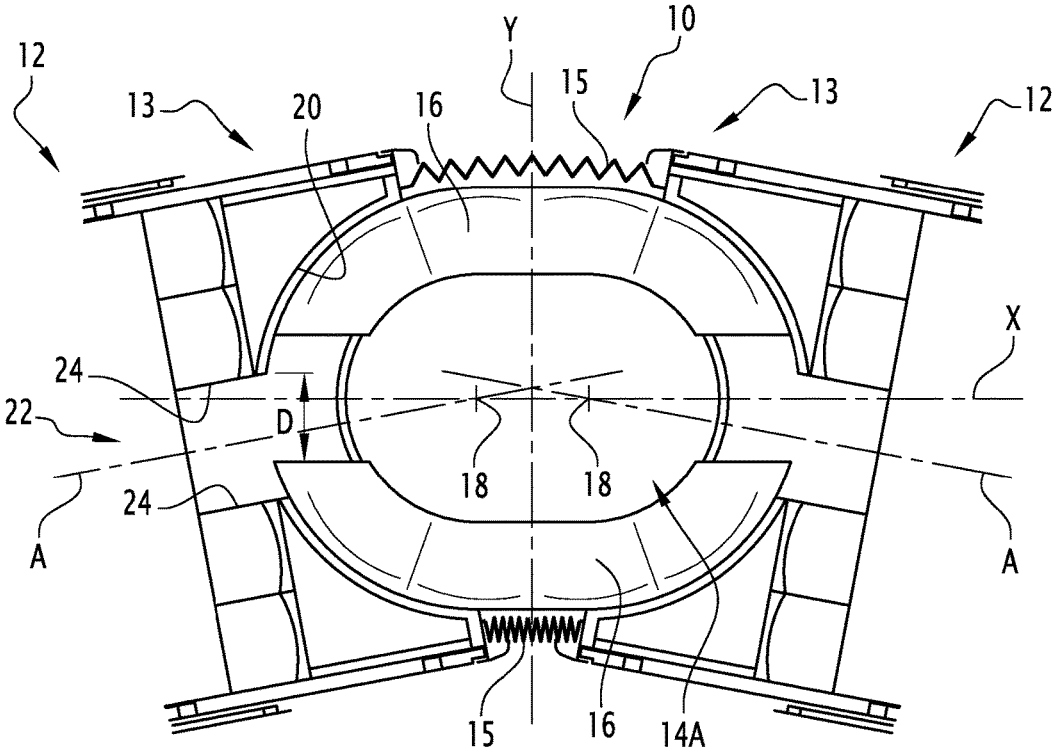
FIG. 2 is a view similar to FIG. 1 of the gangway arrangement of FIG. 1, illustrated in a bend.

In the example illustrated in FIGS. 1 and 2, each seating member 16 partly extends beyond the platform 14. Thus, each end portion 13 of the bodies 12 is laid out so as to allow the seating members 16 to partly extend over this end portion 13. More particularly, a clearance area 20 is made in each end portion 13, each seating member 16 extending in the clearance areas 20.

According to this first embodiment, the platform 14 is provided with two pivot connections 18, each intended to connect this platform 14 to respectively one of the bodies 12. Each pivot connection 18 is laid out below the platform 14, and produced in any conceivable way, known per se. By thus being connected to the bodies 12 through two independent pivots connections 18, the comfort of the platform 14 is improved.

Alternatively, the platform 14 may be provided with a single pivot connection, connecting this platform 14 to each of the bodies 12.

Figure 5:
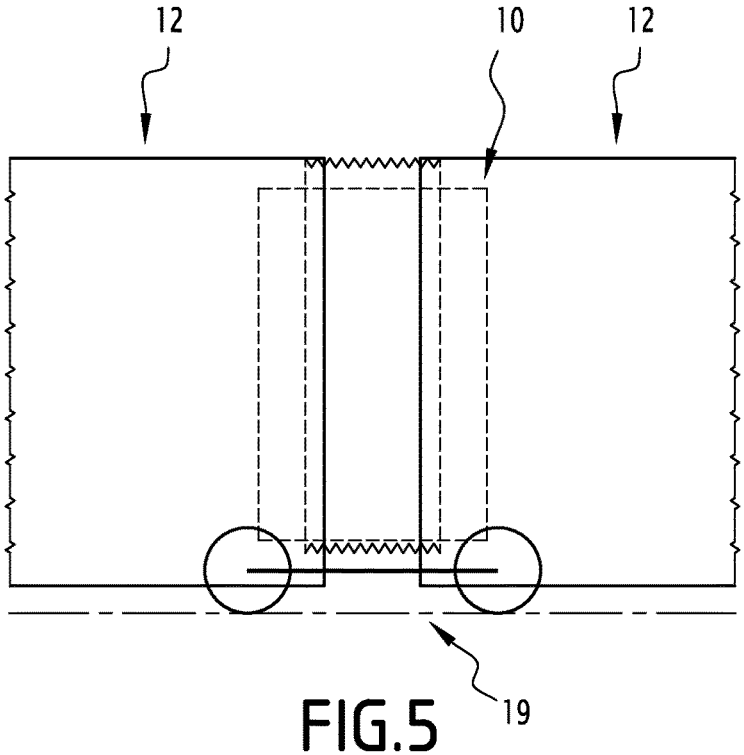
FIGS. 5 and 6 are side views partially illustrating a transport vehicle including a gangway arrangement, respectively illustrated according to first and second alternative embodiments.

Advantageously, as this is illustrated in FIG. 5, this transport vehicle includes at least one bogie 19, this bogie being laid out below the platform 14, and being secured to the platform 14.

Figure 6:
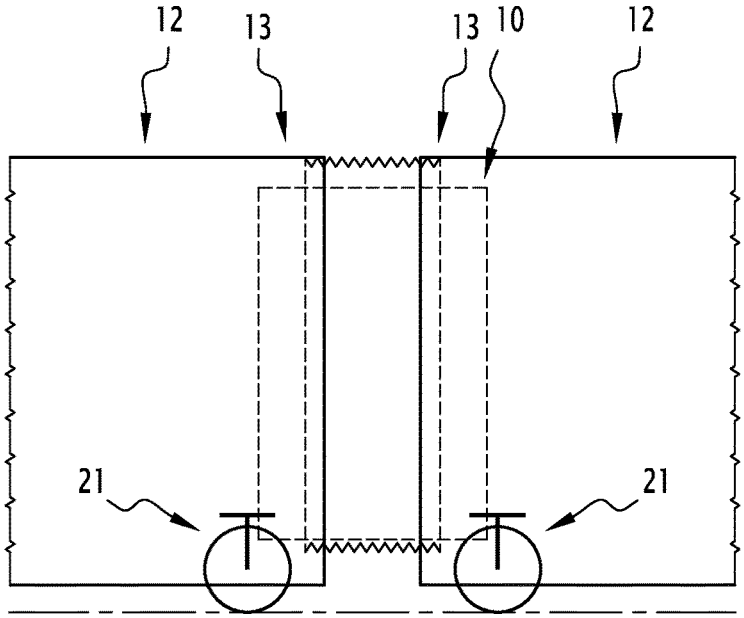

Alternatively, as this is illustrated in FIG. 6, the transport vehicle includes at least two axles 21, each of said axles 21 being laid out below respectively one of said bodies 12, notably below its end portion 13, and being secured to the latter.

Each end portion 13 moreover includes an access corridor 22, delimited by two opposite edges 24. This access corridor 22 opens onto the circulation corridor 14A, and therefore gives the possibility of accessing the gangway arrangement 10.

Each edge 24 is extended, towards the gangway arrangement 10, with an end 17 of respectively one of the seating members 16.

Advantageously, each seating member 16 only extends moderately towards the circulation corridor 14A, in order not to form a significant obstacle for passing between the circulation corridor 14A and one of the access corridors.

For example, the distance D, taken in the transverse direction Y, between each side edge 24 and the end 17 extending the opposite side edge 24, is greater than 450 mm regardless of the tilt of the bodies 12 relatively to each other, as this is notably illustrated in FIG. 2.

This distance D corresponds to the remaining width for passing between the circulation corridor 14A and the access corridor 22. Preferably, this distance D is substantially equal to the distance between the edges 24, or greater than 80% of this distance between the edges 24.

Figure 3:
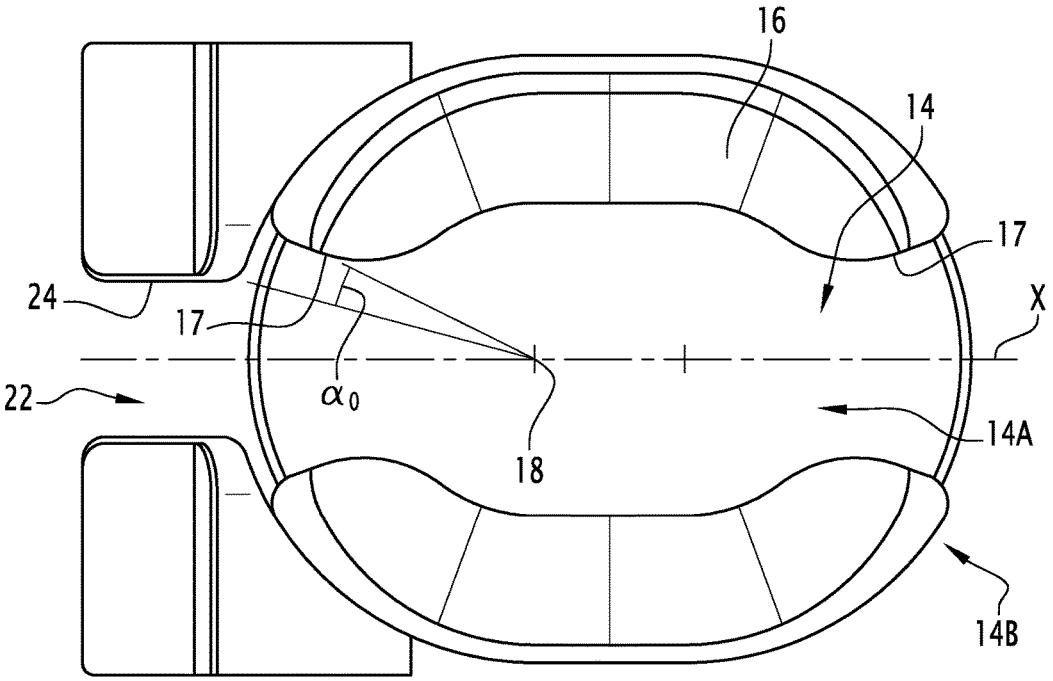
FIGS. 3 and 4 are top views partially illustrating a gangway arrangement according to a second exemplary embodiment, respectively illustrated in a straight line and in a bend taken by the transport vehicle.
Figure 4:
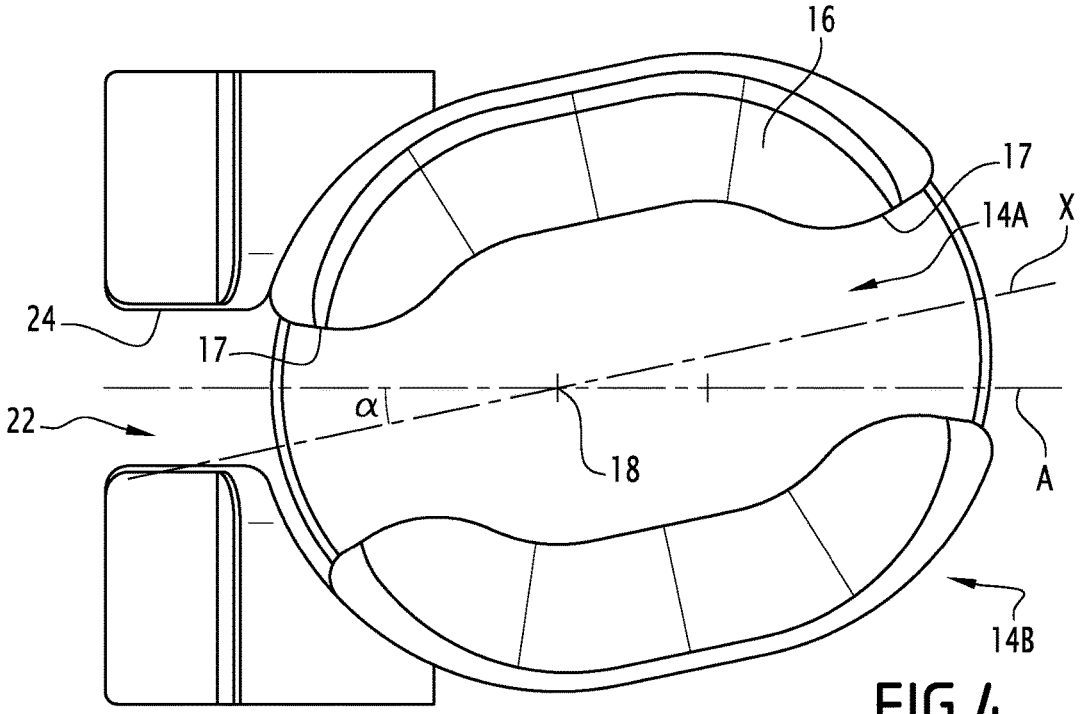

A gangway arrangement according to a second exemplary embodiment of the invention is illustrated in FIGS. 3 and 4. In this second embodiment, the elements similar to those of the first embodiment are designated with identical references, and will not be again described.

According to this second embodiment, each seating member 16 is conformed so that its end 17 will be flush with the corresponding edge 24 when the tilt between both adjacent bodies 12 is maximum. For this purpose, an angular spacing $\alpha_0$ is provided between the end 17 of the seating member 16 and the edge 24 which it extends, when the longitudinal direction X is aligned with the longitudinal axis A of the corresponding body 12. This angular spacing $\alpha_0$ is considered with respect to the pivot connection 18 with the corresponding body 12.

This angular spacing $\alpha_0$ substantially corresponds to the angle $\alpha$ formed between the longitudinal axis A of the body 12 and the longitudinal direction X when the tilt between the adjacent bodies 12 is maximum.

Thus, as this may be seen in FIG. 4, when the bodies 12 are tilted relatively to each other, the ends 17 of each seating member 16 do not form any obstacle between the access corridor 22 and the circulation corridor 14A.

It will be noted that the invention is not limited to the embodiment described earlier, and may have diverse alternatives.

What is claimed is:

1. A gangway arrangement, laid out between two bodies of a public transport jointed vehicle, each body having an end portion, and the gangway arrangement extending along a longitudinal direction, wherein the gangway arrangement includes a circulation corridor along at least one seating member for at least one passenger and wherein:

the gangway arrangement is connected through a pivot connection to the end portion of one of the bodies, this body extending along a longitudinal axis and said end portion comprising an access corridor, delimited by two opposite edges, the seating member has an end extending to one of the edges when the gangway arrangement is connected to the body, an angular spacing is provided between the end of the seating member and the edge which the end extends, when the longitudinal direction is aligned with the longitudinal axis of the corresponding body, the angular spacing being considered relative to the pivot connection with the corresponding body, and the angular spacing equals to the angle formed between the longitudinal axis of the body and the longitudinal direction when the tilt between both bodies is maximum, and wherein the seating member is conformed so that the end will be flush with the corresponding edge when the tilt between both bodies is maximum, so that the end of the seating member does not form any obstacle between the access corridor and the circulation corridor when the bodies are tilted relatively to each other.

2. The gangway arrangement according to claim 1, including a platform, provided with two pivot connections, each intended to connect the platform to respectively one of the bodies.

3. The gangway arrangement according to claim 1, including a platform provided with a pivot connection, intended to connect the platform to each of the bodies.

4. The gangway arrangement according to claim 1, including a platform, wherein the seating member is secured to the platform.

5. The gangway arrangement according to claim 1, including a platform having a general rounded shape.

6. The gangway arrangement according to claim 1, including a platform having an oblong shape.

7. The gangway arrangement according to claim 1, including a platform, wherein the platform includes a central portion, forming a corridor for circulation of persons, and two side portions on either side of the central portion, the seating member being laid out in one of the side portions.

8. The gangway arrangement according to claim 7, wherein each side portion includes at least one seating member, the spacing between the seating members, taken in a transverse direction perpendicular to the longitudinal direction, being greater than 450 mm.

9. A public transport vehicle, including two adjacent bodies, each body having an end portion, the public transport vehicle including a gangway arrangement laid out between both bodies, the gangway arrangement extending along a longitudinal direction, wherein the gangway arrangement includes at least one seating member for at least one passenger and wherein:

the gangway arrangement is connected through a pivot connection to the end portion of one of the bodies, this body extending along a longitudinal axis and said end portion comprising an access corridor, delimited by two opposite edges, the seating member has an end extending to one of the edges when the gangway arrangement is connected to the body, an angular spacing is provided between the end of the seating member and the edge which the end extends, when the longitudinal direction is aligned with the longitudinal axis of the corresponding body, the angular spacing being considered relatively to the pivot connection with the corresponding body, and the angular spacing equals the angle formed between the longitudinal axis of the body and the longitudinal direction when the tilt between both bodies is maximum, and wherein the seating member is conformed so that the end will be flush with the corresponding edge when the tilt between both bodies is maximum, so that the end of the seating member does not form any obstacle between the access corridor and the circulation corridor when the bodies are tilted relatively to each other.

10. The public transport vehicle according to claim 9, wherein the gangway arrangement includes a platform, wherein the platform includes a central portion, forming a corridor for circulation of persons, and two side portions on either side of the central portion, the seating member being laid out in one of the side portions.

11. The public transport vehicle according to claim 10, wherein each side portion includes at least one seating member, the spacing between the seating members, taken in a transverse direction perpendicular to the longitudinal direction, being greater than 450 mm.

12. The public transport vehicle according to claim 10, comprising a corridor for accessing the gangway arrangement, opening onto said circulation corridor, and delimited by two side edges, the distance between each side edge and the seating member laid out in the opposite side portion being greater than 450 mm regardless of the tilt of the bodies relatively to each other.

13. The public transport vehicle according to claim 9, forming a railway vehicle, wherein the gangway arrangement includes a platform, and wherein the public transport vehicle comprises at least one bogie, said bogie being laid out below said platform, and being secured to this platform.

14. The public transport vehicle according to claim 9, forming a railway vehicle, comprising at least two axles, each of said axles being laid out below respectively one of said bodies, and being secured to said body.

* * * * *